US008350555B2

(12) United States Patent
Kim et al.

(10) Patent No.: US 8,350,555 B2
(45) **Date of Patent: *Jan. 8, 2013**

(54) REFERENCE VOLTAGE GENERATING APPARATUS AND METHOD THEREOF FOR REMOVING TEMPERATURE INVARIANT CURRENT COMPONENTS FROM A REFERENCE CURRENT

(75) Inventors: Hyoung-Rae Kim, Hwaseong-si (KR); Hyo-Sun Kim, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/413,392

(22) Filed: Mar. 6, 2012

(65) Prior Publication Data

US 2012/0161744 A1 Jun. 28, 2012

Related U.S. Application Data

(63) Continuation of application No. 12/478,338, filed on Jun. 4, 2009, now Pat. No. 8,154,272.

(30) Foreign Application Priority Data

Jun. 5, 2008 (KR) ..... 10-2008-0053127

(51) Int. Cl.
*G05F 3/16* (2006.01)

(52) U.S. Cl. ..... 323/314; 323/316; 323/907

(58) Field of Classification Search ..... 323/313, 323/314, 315, 316, 907
See application file for complete search history.

(56) References Cited

U.S. PATENT DOCUMENTS

| | | | | |
|---|---|---|---|---|
| 5,945,821 | A * | 8/1999 | Sakurai et al. | 323/313 |
| 6,097,180 | A * | 8/2000 | Tsukude et al. | 323/313 |
| 6,111,397 | A * | 8/2000 | Leung | 323/315 |
| 6,958,597 | B1 * | 10/2005 | Lin et al. | 323/313 |
| 7,282,901 | B2 * | 10/2007 | Pletersek | 323/313 |
| 7,486,065 | B2 * | 2/2009 | Lin et al. | 323/313 |
| 7,659,706 | B2 * | 2/2010 | Nishida | 323/314 |
| 8,154,272 | B2 * | 4/2012 | Kim et al. | 323/314 |
| 2011/0043185 | A1 * | 2/2011 | Kim | 323/313 |

FOREIGN PATENT DOCUMENTS

| | | | |
|---|---|---|---|
| JP | 06139779 | * | 5/1994 |
| JP | 2002184178 | * | 6/2002 |
| JP | 2003078366 | * | 3/2003 |
| JP | 2004304564 | * | 10/2004 |

* cited by examiner

*Primary Examiner* — Jeffrey Sterrett
(74) *Attorney, Agent, or Firm* — F. Chau & Associates, LLC

(57) ABSTRACT

A method and apparatus for generating a low reference voltage having low power consumption characteristics is provided. A reference voltage generating apparatus includes a constant current source circuit which generates a reference current. A load circuit is connected to the constant current source circuit and generates a voltage which is proportional to the reference current. A current branch circuit removes a portion of temperature-invariant current components included in the reference current from a connection terminal of the constant current source circuit and the load circuit to a ground terminal through a current branch which is different from a current branch of the load circuit.

20 Claims, 16 Drawing Sheets

REFERENCE VOLTAGE GENERATING APPARATUS AND METHOD THEREOF FOR REMOVING TEMPERATURE INVARIANT CURRENT COMPONENTS FROM A REFERENCE CURRENT

CROSS-REFERENCE TO RELATED APPLICATION

This application is a Continuation Application of U.S. patent application Ser. No. 12/478,338 filed on Jun. 4, 2009, now U.S. Pat. No. 8,154,272 which claims priority to and the benefit of Korean Patent Application No. 10-2008-0053127, filed on Jun. 5, 2008, in the Korean Intellectual Property Office, the entire content of which are incorporated by reference herein.

BACKGROUND

The present disclosure relates to a reference voltage generating apparatus and method, and more particularly, to a method and apparatus for generating a low reference voltage having low power consumption characteristics.

Since driving voltages of logic circuits for large scale integrated circuits (LSICs), are becoming lower, reference voltages needed for integrated circuits (ICs) also become lower.

The reference voltages of the IC may be influenced by semiconductor process variations or temperature variations.

Also, ICs used in small electronic devices such as mobile devices demand low power consumption and minimum circuit size. As such, circuits that generate low reference voltages at low power consumption and which are not influenced by process or temperature variations are desirable.

SUMMARY

Exemplary embodiments of the present invention provide methods and apparatus for stably generating a low reference voltage having low power consumption characteristics.

In accordance with an exemplary embodiment a reference voltage generating apparatus includes a constant current source circuit which generates a reference current, the reference current including temperature-invariant current components. A load circuit is connected to the constant current source circuit and is connected to ground through a load circuit current branch, and generates a voltage proportional to the reference current. A current branch circuit removes at least a portion of the temperature-invariant current components from a connection terminal of the constant current source circuit and the load circuit to a ground terminal through a current branch different from the load circuit current branch.

The reference current may include both the temperature-invariant current components and temperature-variant current components.

The temperature-variant current components may include current components which vary in proportion to absolute temperature.

The load circuit may include a diode and a resistance device connected in series between an output of the constant current source circuit and a ground terminal.

The load circuit may include a transistor and a resistance device connected in series between an output of the constant current source circuit and a ground terminal.

A drain terminal of the transistor may be connected to an output terminal of the constant current source circuit. A source terminal of the transistor may be connected to a first terminal of the resistance device. A gate terminal of the transistor may be connected to the drain terminal. A second terminal of the resistance device may be connected to the ground terminal.

The current branch circuit may include a circuit which removes the portion of the temperature-invariant current components from the connection terminal of the constant current source circuit and the load circuit to a ground terminal through a resistance device of a current branch different from the load circuit current branch.

The current branch circuit may remove the portion of the temperature-invariant current components from the connection terminal of the constant current source circuit and the load circuit to a ground terminal through a plurality of serial-connected resistance devices of a current branch which is different from the load circuit current branch, and may select one of nodes to which the plurality of the resistance devices are connected, as an output terminal.

Resistances of the load circuit and the current branch circuit may be determined such that electrical characteristics of the constant current source circuit and electrical characteristics of the load circuit are equalized.

Resistances of the load circuit and the current branch circuit may be determined such that voltages output from the connection terminal of the constant current source circuit and the load circuit are generated regardless of temperature variations.

The constant current source circuit may include a plurality of cascode current mirror circuits. A voltage used by each transistor in the cascode current mirror circuits may be applied using self bias.

The constant current source circuit may include: a cascode current mirror circuit in which first and second current paths are between a source voltage terminal and the ground terminal and a plurality of current mirror circuits, which cause the same voltage to flow through the first and second current paths, are cascode-connected; a resistance device, connected to one of the first and second current paths, that controls a current flowing through a connected current path; and a buffer circuit, connected to one of the first and second current paths, that causes a current to flow to an output terminal, the current being the same current as a current flowing through a connected current path.

A bias voltage that operates the cascode current mirror circuit may be generated using self bias without an additional current branch.

The cascode current mirror circuit may include a self bias transistor in each of the first and second current paths that generates a bias voltage used for the current mirror circuits forming the first and second current paths, by using a voltage applied to the self bias transistor.

The reference voltage generating apparatus may further include an operational amplifying circuit which amplifies voltages applied to the connection terminal of the constant current source circuit and the load circuit. A target voltage may be generated by controlling a gain of the operational amplifying circuit.

The operational amplifying circuit may include an operational amplifier and a resistance circuit coupled between an output of the operational amplifying circuit and a non-inverting terminal of the operational amplifier. The resistance circuit may include a first resistor set and a second resistor set whose resistances are controlled according to whether fuses coupled in parallel to respective resistances are cut. A first input terminal of the operational amplifier may be connected to the connection terminal of the constant current source circuit and the load circuit. The first resistor set may be connected between a second input terminal and an output terminal of the operational amplifier. The second resistor set may be connected between the second input terminal of the operational amplifier and the ground terminal.

Each of the first resistor set and the second resistor set may include an initial setting resistance device and a plurality of controlling resistance devices connected in series. A fuse may be connected to both terminals of each of the controlling resistance devices.

In an exemplary embodiment reference voltage generating method is provided. A reference current is generated from a constant current source circuit, the constant current source circuit being coupled to ground through a load circuit current branch. A portion of temperature-invariant current components included in the reference current is removed to a ground terminal through a current branch different from the load circuit current branch. Remaining current components obtained by removing the portion of the temperature-invariant current components from the reference current are converted into a reference voltage.

A resistance of the load circuit current branch and a resistance of the current branch for removing a portion of the temperature-invariant current components may be determined to satisfy a condition for equalizing electrical characteristics of the constant current source circuit and electrical characteristics of the load circuit current branch.

In an exemplary embodiment a method of generating a reference voltage is provided. A pair of current mirror circuits is cascade-connected. A pair of self-bias transistors is provided between the pair of current mirror circuits. Currents are generated through current paths of the current mirror circuits A pair of transistors are cascade-connected to a current path of one of the pair of current minor circuits to output a reference current. A portion of temperature invariant current components of the reference current are removed through a current branch coupled to the cascade-connected pair of transistors. A non-inverting input of an operational amplifier is coupled to the current branch and regulates an output of the operational amplifier by feedback coupling a variable resistance between the output and the inverting input of the operational amplifier.

BRIEF DESCRIPTION OF THE DRAWINGS

Exemplary embodiments of the present invention will be more clearly understood from the following detailed description taken in conjunction with the accompanying drawings in which.

DETAILED DESCRIPTION OF EXEMPLARY EMBODIMENTS

Hereinbelow, various exemplary embodiments of sub-circuits used in implementing the reference voltage generating apparatus in accordance with the present invention are first described. Exemplary sub-circuits are then combined to provide an overall reference voltage generating apparatus.

Figure 1:
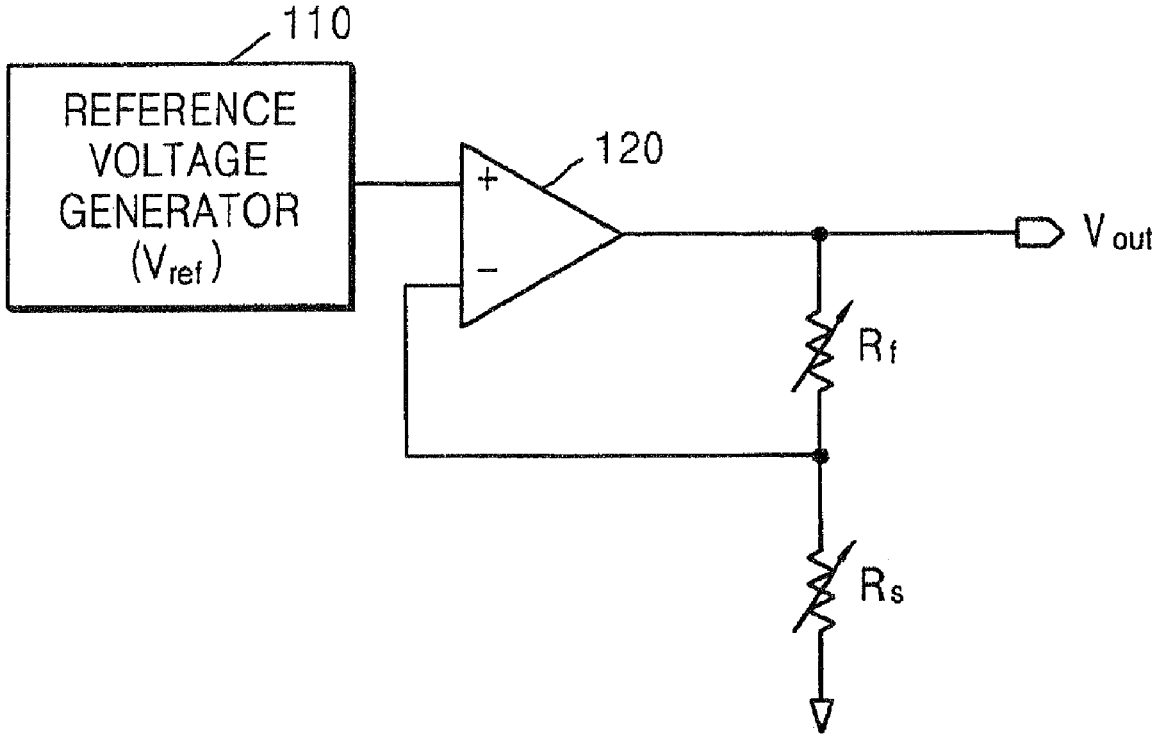
FIG. 1 is a circuit diagram of a reference voltage generating apparatus in accordance with an exemplary embodiment of the present invention.

First, turning to FIG. 1, a circuit diagram of a reference voltage generating apparatus in accordance with an exemplary embodiment of the present invention is shown. The reference voltage generating apparatus includes a reference voltage generator 110, an operational amplifier 120, and a plurality of resistors Rf, Rs.

The reference voltage generator 110 is a circuit for generating a bandgap reference voltage Vref which takes into consideration temperature variations. The bandgap reference voltage Vref is fixed at approximately 1.2 V.

The bandgap reference voltage Vref generated by the reference voltage generator 110 is input to the operational amplifier 120 and the reference voltage generating apparatus generates a desired output voltage Vout by controlling the resistors Rf, Rs in Equation [1].

$$Vout = Vref\left(1 + \frac{R_f}{R_S}\right) \approx 1.2\left(1 + \frac{R_f}{R_S}\right) \quad \text{Equation [1]}$$

As determined by Equation [1], a reference voltage lower then 1.2 V cannot be generated by the reference voltage generating apparatus illustrated in FIG. 1.

An exemplary embodiment of the present invention provides a reference voltage generating circuit that can generate a reference voltage lower then 1.2V, and more particularly, a circuit for stably generating a low reference voltage for a low power consumption, and which minimizes the size of a semiconductor circuit and is also not influenced by a semiconductor process variations or temperature variations.

Typically, a reference voltage generating apparatus uses a current source circuit formed as a current mirror circuit. To reduce the influence of channel length modulation of transistors used in the current mirror circuit, the resistance of an output terminal of the current mirror circuit is made as large as possible.

For this, a cascode constant current source circuit may be used as the current mirror circuit. The basic cascode circuit is typically a two-stage amplifier followed by a resistive load. It is often constructed from two transistors, with one transistor operating as a load of the input transistor's output drain terminal. The cascode constant current source circuit causes a shielding effect, in which source voltage variations do not influence a bias current or voltage, by adding one more group of transistors thereto.

However, a cascode current mirror circuit has a headroom loss due to a threshold voltage Vth of a transistor and thus a low-voltage cascode bias circuit is typically used. In low-voltage cascode bias circuits the influence of channel length variations is reduced so as to improve current consistency between one current mirror path and another current mirror path and a voltage headroom loss is minimized so as to achieve a wide output swing.

Figure 2A:
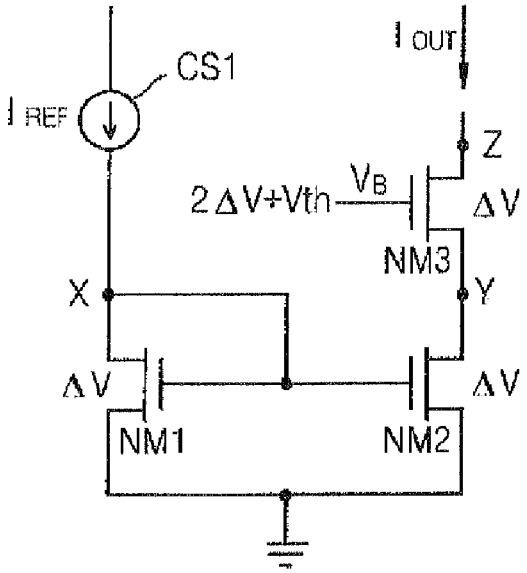
FIG. 2A is a circuit diagram for describing a basic concept of a bias method of a low-voltage cascode circuit as a current mirror circuit, in accordance with an exemplary embodiment of the present invention.
Figure 2B:
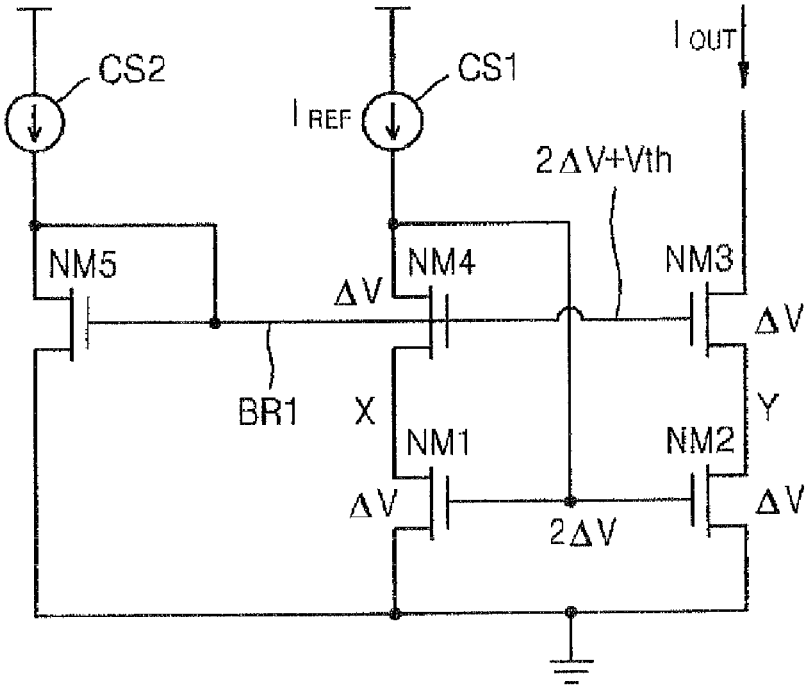
FIG. 2B is a circuit diagram of a low-voltage cascode circuit according to an exemplary embodiment of the bias method illustrated in FIG. 2A.

FIG. 2A is a circuit diagram for describing a bias method of a low-voltage cascode circuit as a current mirror circuit in accordance with an exemplary embodiment of the present invention. FIG. 2B is a circuit diagram of a low-voltage cascode circuit which can implement the bias method illustrated in FIG. 2A.

In the current mirror circuit illustrated in FIG. 2A, node X is a drain terminal of a transistor NM1 and node Y is a drain terminal of a transistor NM2 and have the same potential, such as a minimum voltage ΔV, and a voltage of 2ΔV+Vth is applied to a gate terminal of a cascode output transistor NM3. In this case, a minimum ultimate output voltage at node Z is 2ΔV. Here, ΔV is a drain-source terminal voltage when an n-channel metal-oxide semiconductor (NMOS) transistor is turned on, and Vth is a threshold voltage of the NMOS transistor.

However, as illustrated in FIG. 2B, a current branch BR1 is needed for applying a bias voltage to the low-voltage cascode circuit, and thus the low-voltage cascode circuit illustrated in FIG. 2B may not be appropriate for low power characteristics.

Figure 3A:
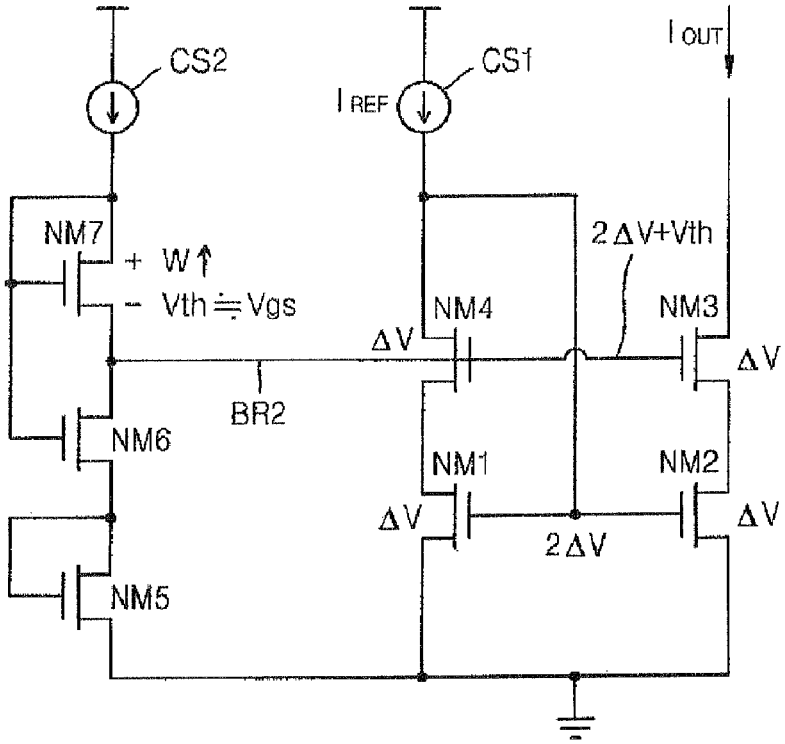
FIG. 3A is a circuit diagram of a low-voltage cascode circuit according to an exemplary embodiment of the bias method illustrated in FIG. 2A.
Figure 3B:
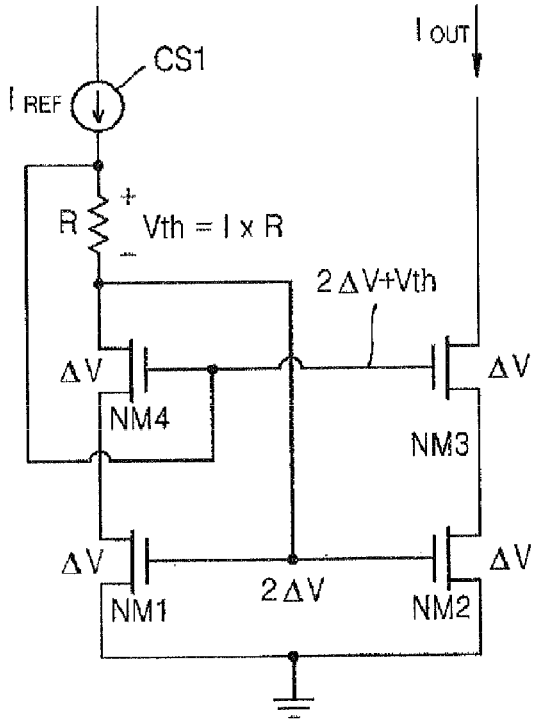
FIG. 3B is a circuit diagram of a low-voltage cascode circuit according to a third exemplary embodiment of the bias method illustrated in FIG. 2A.

FIGS. 3A and 3B are circuit diagrams of a low-voltage cascode circuits according to the exemplary embodiment of the bias method illustrated in FIG. 2A.

The low-voltage cascode circuit illustrated in FIG. 3A is similar to the circuit illustrated in FIG. 2A, but has an additional current branch BR2 and, as such, the semiconductor circuit area increases. On the other hand, in the case of the low-voltage cascode circuit illustrated in FIG. 3B, the additional current branch is not needed.

In FIG. 3B a circuit is provided to generate a bias voltage by using a resistor R and thus a threshold voltage Vth of 0.7 V is applied between both terminals of the resistor R. An IC for a mobile device, for which low power characteristics are important, operates all transistor devices in a weak inversion state and thus the current of each branch is equal to or less than approximately 500 nA. Accordingly, V(0.7 V)=I(500 nA)×R and thus the resistor R is 1.4 MΩ. As such, the circuit area greatly increases due to a large resistance and the low-voltage cascode circuit becomes sensitive to variations in process distributions due to the use of a resistance device. Thus, the embodiments of the low-voltage cascode circuits illustrated in FIGS. 3A and 3B may not be appropriate for small areas and low power characteristics.

Figure 10:
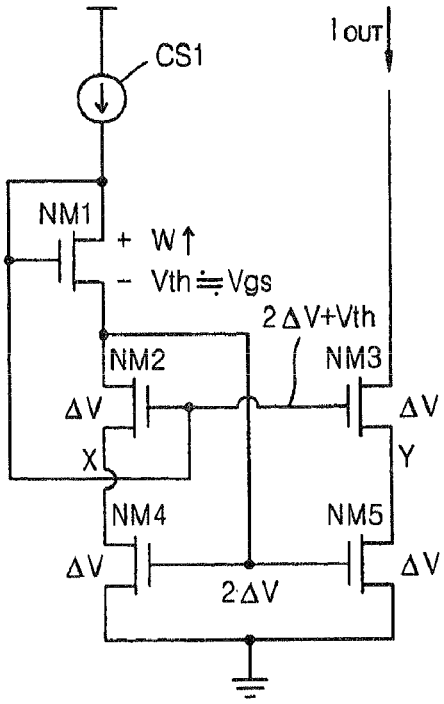
FIG. 10 is a circuit diagram of a constant current source circuit adopting self bias according to an exemplary embodiment of the present invention.

FIG. 10 is a circuit diagram of a constant current source circuit adopting self bias according to an exemplary embodiment of the present invention. The constant current source circuit includes a first current mirror circuit including transistors NM2, NM3, a second current mirror circuit including transistors NM4, NM5, a self bias transistor NM1, and a constant current source CS1.

The transistor NM2 included in the first current mirror circuit is cascode-connected with the transistor NM4 in the second current mirror circuit. The transistor NM3 included in the first current mirror circuit is cascode-connected with the transistor NM5 in the second current mirror circuit. The self bias transistor NM1 is connected between the constant current source CS1 and a drain terminal of the transistor NM2 included in the first current mirror circuit. Here, a gate terminal of the self bias transistor NM1 is connected to a drain terminal of the self bias transistor NM1 by using a common terminal so as to function as a diode.

A bias voltage is applied to each of the first and second current mirror circuits which are separately cascode-connected by connecting gate terminals of the transistors NM4, NM5 of the second current mirror circuit to the drain terminal of the transistor NM2 and connecting gate terminals of the transistors NM2, NM3 of the first current mirror circuit to the common terminal between the gate and drain terminals of the self bias transistor NM1.

A current $I_{REF}$ generated from the constant current source CS1 is a weak inversion current and thus, if a channel width of the self bias transistor NM1 increases, a gate-source terminal voltage Vgs approaches a threshold voltage Vth. Accordingly, a bias voltage of 2ΔV+Vth is applied to each of the gate terminals of the transistors NM2, NM3 of the first current mirror circuit. In particular, if the body of the self bias transistor NM1 is directly connected to its source terminal instead of a ground voltage, a body effect may be ignored.

Thus, according to the self bias method, the bias voltage of 2ΔV+Vth is applied to each of gate terminals of the transistors NM2, NM3 of the first current mirror circuit.

As a result, according to the constant current source circuit adopting the self bias method according to the current exemplary embodiment of the present invention, in comparison to the bias method illustrated in FIGS. 2B and 3A, power consumption can be reduced and also a circuit area can be reduced because an additional current branch is not used. Furthermore, in comparison to the bias method illustrated in FIG. 3B, the circuit area can be reduced because a bias resistance device having a large resistance is not used, and also the constant current source circuit does not become sensitive to process variations because a resistance device is not used.

Figure 11A:
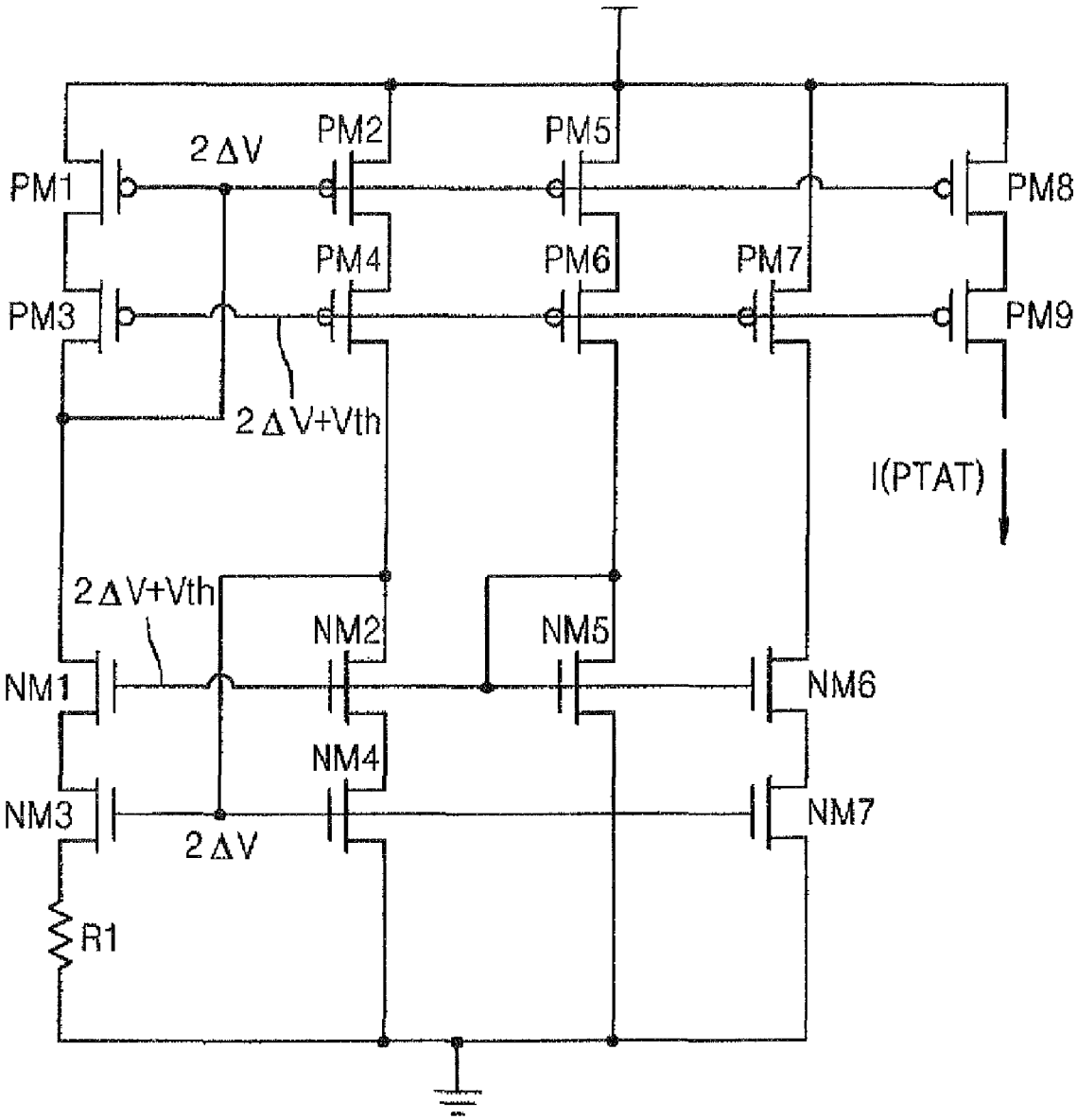
FIG. 11A is a detailed circuit diagram of a constant current source circuit adopting the bias method illustrated in FIG. 2B.
Figure 11B:
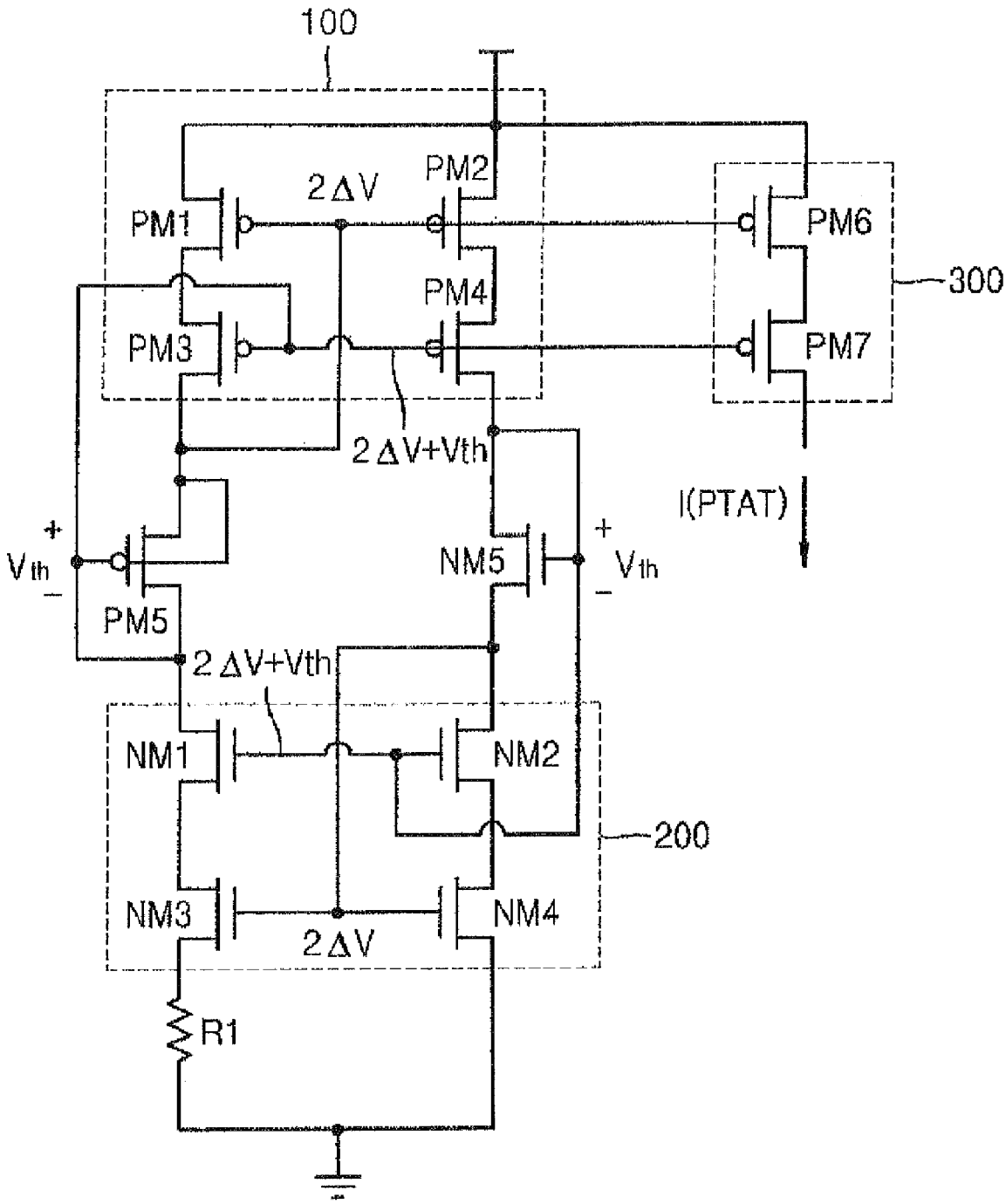
FIG. 11B is a detailed circuit diagram of a constant current source circuit adopting self bias according to an exemplary embodiment of the present invention.

FIG. 11B is a detailed circuit diagram of a constant current source circuit included in a reference voltage generating apparatus adopting self bias according to an exemplary embodiment of the present invention. The constant current source circuit includes a first cascode current mirror circuit 100, a second cascode current mirror circuit 200, a resistor R1, self bias transistors PM5, NM5, and a buffer 300.

In the first cascode current mirror circuit 100, transistors functioning as a current mirror circuit are cascode-connected between first and second current paths such that the same current flows through the first and second current paths.

In more detail, transistors PM1, PM3 are cascode-connected. Transistors PM2, PM4 are also cascode-connected. Source terminals of the transistors PM1, PM2 are connected to a source voltage. A gate terminal of the transistor PM1 is connected to a gate terminal of the transistor PM2. A gate terminal of the transistor PM3 is connected to a gate terminal of the transistor PM4. The gate terminal of the transistor PM1 is connected to a drain terminal of the transistor PM3.

In the second cascode current mirror circuit 200, transistors functioning as a current mirror circuit are cascode-connected to first and second current paths such that the same current flows through the first and second current paths.

The self bias transistors PM5, NM5 are connected between the first and second cascode current mirror circuits 100, 200.

In more detail, transistors NM1, NM3 are cascode-connected. Transistors NM2, NM4 are also cascode-connected. A gate terminal of the transistor NM1 is connected to a gate terminal of the transistor NM2. A gate terminal of the transistor NM3 is connected to a gate terminal of the transistor NM4. The gate terminal of the transistor NM4 is connected to a drain terminal of the transistor NM2. A source terminal of the transistor NM4 is connected to a ground voltage. The resistor R1 is connected between a drain terminal of the transistor NM3 and the ground voltage.

A source terminal of the self bias transistor PM5 is connected to the drain terminal of the transistor PM3 included in the first cascode current mirror circuit 100. A drain terminal of the self bias transistor PM5 is connected to a drain terminal of the transistor NM1 included in the second cascode current mirror circuit 200. A gate terminal of the self bias transistor PM5 is connected to the drain terminal of the self bias transistor PM5 so as to function as a diode, and a common terminal to which the gate and drain terminals of the self bias transistor PM5 are connected is connected to the gate terminals of the transistors PM3, PM4.

As described above in relation to FIG. 10, a channel width of the self bias transistor PM5 is designed to be large so that a gate-source terminal voltage Vgs approaches a threshold voltage Vth. Also, the body of the self bias transistor PM5 is designed to be directly connected to its source terminal so that a body effect may be ignored.

Thus, a bias voltage of $2\Delta V+Vth$ is applied to each of the gate terminals of the transistors PM3, PM4 included in the first cascode current mirror circuit 100. Here, $\Delta V$ is a drain-source terminal voltage when an NMOS transistor is turned on, and Vth is a threshold voltage of the NMOS transistor.

Also, a drain terminal of the self bias transistor NM5 is connected to a drain terminal of the transistor PM4 included in the first cascode current mirror circuit 100. A source terminal of the self bias transistor NM5 is connected to the drain terminal of the transistor NM2 included in the second cascode current mirror circuit 200. A gate terminal of the self bias transistor NM5 is connected to the drain terminal of the self bias transistor NM5 so as to function as a diode. A common terminal to which the gate and drain terminals of the self bias transistor NM5 are connected is connected to the gate terminals of the transistors NM1, NM2.

As described above in relation to FIG. 10, the channel width of the self bias transistor NM5 is designed to be large so that a gate-source terminal voltage Vgs approaches a threshold voltage Vth. Also, the body of the self bias transistor NM5 is directly connected to its source terminal so that a body effect may be ignored.

Thus, a bias voltage of $2\Delta V+Vth$ is applied to each of the gate terminals of the transistors NM1, NM2 included in the second cascode current mirror circuit 200.

Transistors PM6, PM7 included in the buffer 300 are cascode-connected so as to copy and output a reference current generated by the constant current source circuit. In more detail, a source terminal of the transistor PM6 is connected to the source voltage and a drain terminal of the transistor PM6 is connected to a source terminal of the transistor PM7. Also, a gate terminal of the transistor PM6 is connected to the gate terminals of the transistors PM1, PM2 included in the first cascode current mirror circuit 100. A gate terminal of the transistor PM7 is connected to the gate terminals of the transistors PM3, PM4 included in the first cascode current mirror circuit 100 such that a drain terminal of the transistor PM7 outputs a current I(PTAT) that is the same as a current flowing through the drain terminal of the transistor PM3 included in the first cascode current mirror circuit 100. Here, the current I(PTAT) proportionally increases as absolute temperature increases.

In the constant current source circuit included in the reference voltage generating apparatus adopting the self bias method illustrated in FIG. 11B, when the transistors NM1, NM2, NM3, NM4 of the second cascode current mirror circuit 200 are turned on and thus a current starts flowing, the transistors PM1, PM2, PM3, PM4 of the first cascode current mirror circuit 100 are also turned on due to self biasing.

Also, when the transistors PM1, PM2, PM3, PM4 of the first cascode current mirror circuit 100 and the transistors NM, NM2, NM3, NM4 of the second cascode current mirror circuit 200 are turned on and thus a current starts flowing, a constant bias voltage is applied to the gate terminals of the transistors PM1, PM2, PM3, PM4, NM1, NM2, NM3, NM4 such that a constant current continuously flows. Furthermore, the current I(PTAT) output from the constant current source circuit is controlled by the resistor R1.

While FIG. 11A is a detailed circuit diagram of a constant current source circuit adopting the bias method illustrated in FIG. 2B, the constant current source circuit illustrated in FIG. 11B, which adopts the self bias method according to an exemplary embodiment of the present invention, has a simple circuit configuration and is thus appropriate for small areas and low power devices, as compared with the constant current source circuit illustrated in FIG. 11A.

Turning now to the matter of temperature, the operation of the reference voltage generating circuit needs to take into consideration temperature variations.

Figure 4:
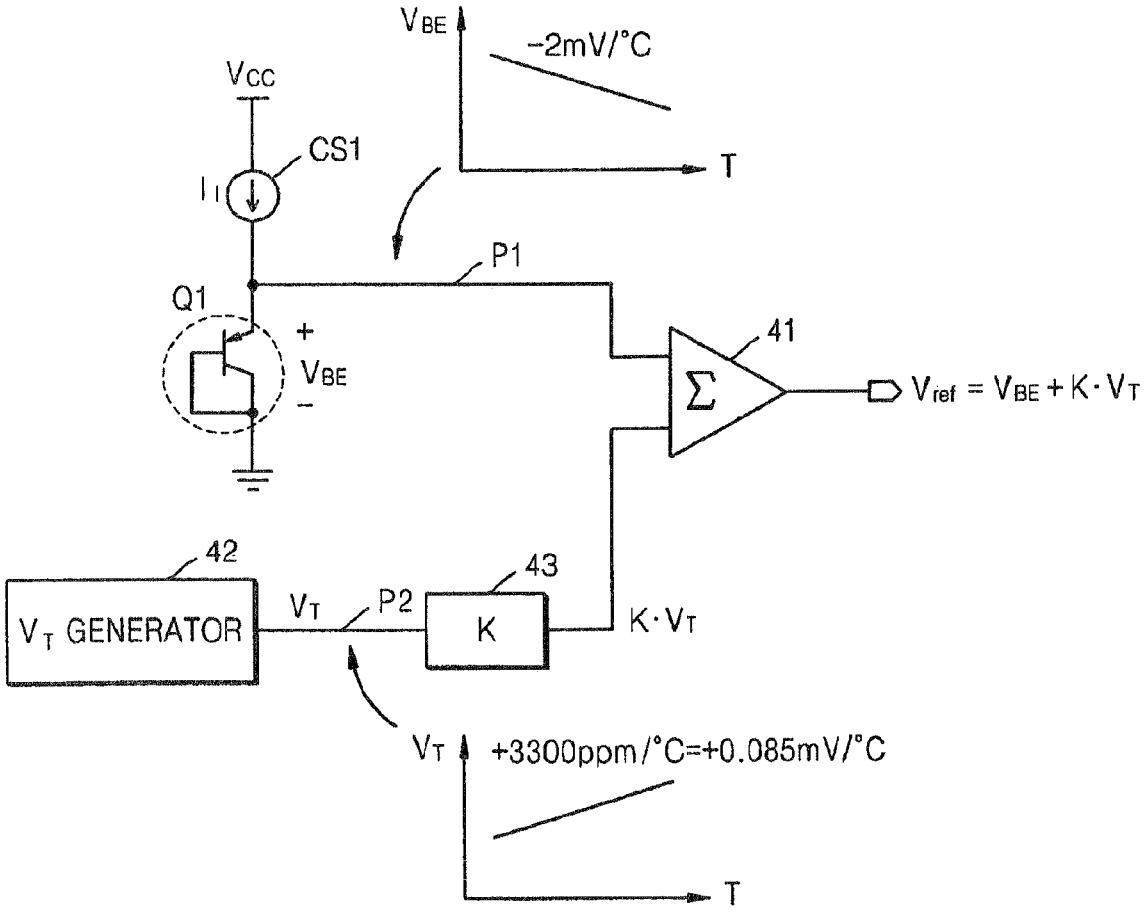
FIG. 4 is a schematic diagram for describing a concept of a bandgap reference voltage circuit in accordance with an exemplary embodiment of the present invention.

FIG. 4 is a schematic diagram for describing a bandgap reference voltage circuit in accordance with an exemplary embodiment of the present invention. A constant current source CS1 is connected to a transistor Q1 such that a base-emitter terminal voltage $V_{BE}$ is generated in an emitter terminal of the transistor Q1 and is applied to a first input terminal of an adder 41.

Also, a voltage $V_T$ generated in a $V_T$ generator 42 is multiplied by a temperature constant K by a multiplier 43 such that $K \cdot V_T$ is applied to a second input terminal of the adder 41.

Accordingly, an output voltage Vref of the adder 41 is $V_{BE}+K \cdot V_T$. Here, the base-emitter terminal voltage $V_{BE}$ is inversely proportional to temperature and the voltage $V_T$ is proportional to temperature.

Figure 5:
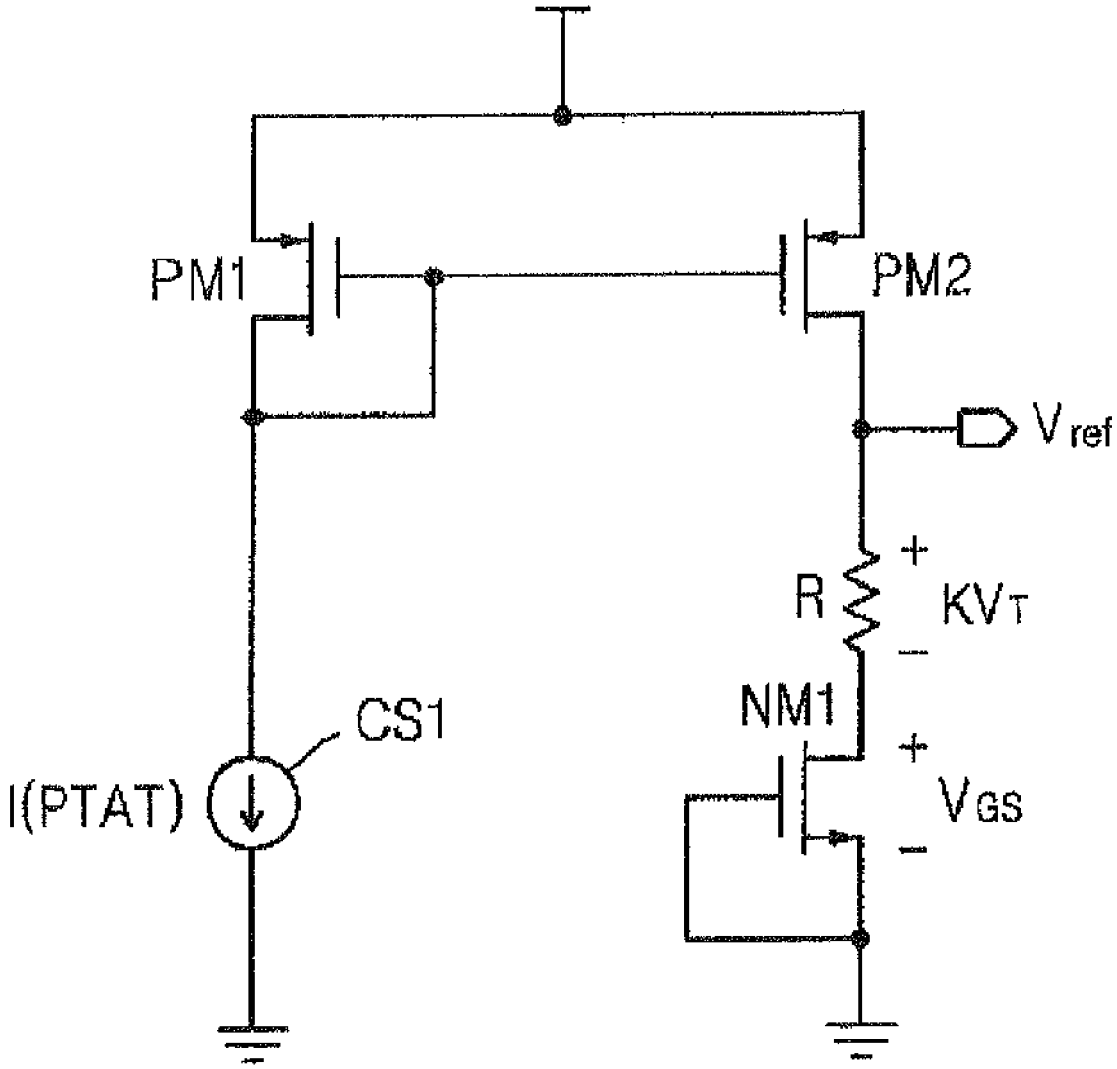
FIG. 5 is a circuit diagram of a circuit used to implement the concept described in FIG. 4.

FIG. 5 is a circuit diagram of an exemplary embodiment of a circuit which implements the concept described in FIG. 4. All transistors operate in a weak inversion state. A voltage $V_{GS}$ is 0.7 V and a voltage $V_T$ is 26 mV, and thus a temperature constant K is approximately 17-19. A resistor R is such that the temperature constant K may be obtained. A Proportional To Absolute Temperature (PTAT) voltage which is directly proportional to temperature and a Complementary To Absolute Temperature (CTAT) voltage which is the voltage $V_{GS}$ and is inversely proportional to temperature, are generated by using a PTAT current and the resistor R, and an output voltage Vref is generated by summing the PTAT voltage and the CTAT voltage so as to be output from a zero-thermal coefficient (TC) bandgap reference voltage generating circuit. However, the output voltage Vref of the zero-TC bandgap reference voltage generating circuit is a high voltage of 1.2 V (silicon (Si) bandgap voltage). Thus, the zero-TC bandgap reference voltage generating circuit operates only at an applied voltage higher than or equal to 1.2 V and may not be appropriate when a reference voltage lower than 1.2 V is used.

Figure 6A:
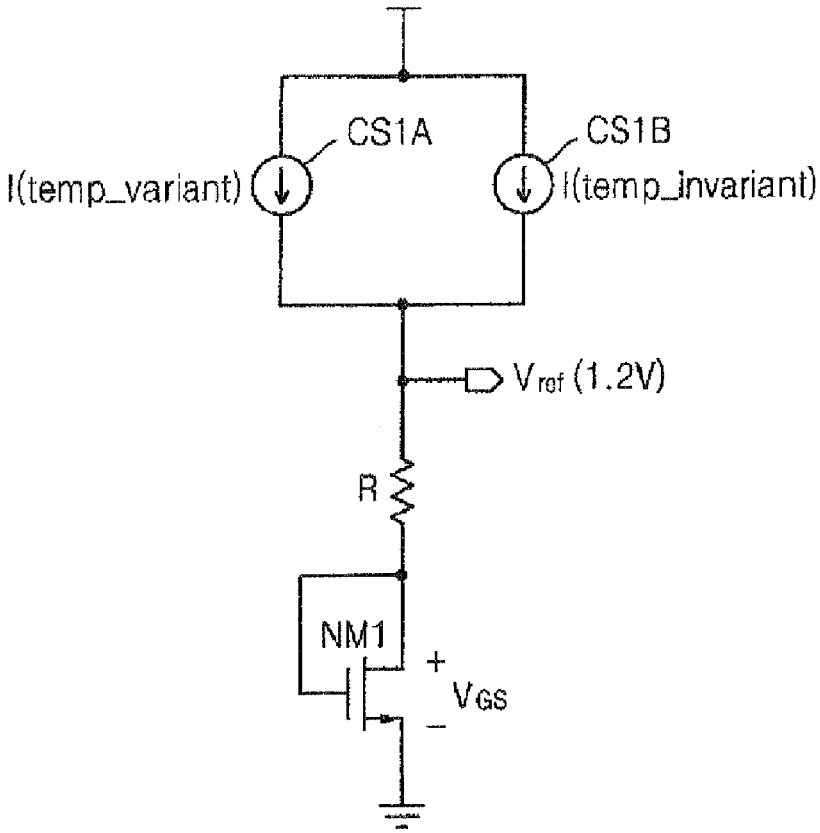
FIG. 6A is an equivalent circuit diagram of the circuit illustrated in FIG. 5.
Figure 6B:
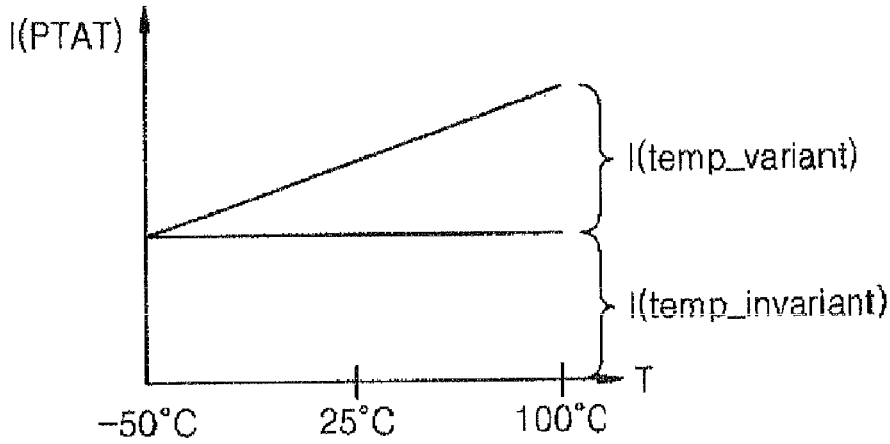
FIG. 6B is a graph showing temperature characteristics of a reference current for generating a reference voltage illustrated in FIG. 6A.

FIG. 6A is an equivalent circuit diagram of the circuit illustrated in FIG. 5. FIG. 6B is a graph showing temperature characteristics of a reference current for generating a reference voltage illustrated in FIG. 6A.

If the circuit illustrated in FIG. 5 is re-represented as illustrated by the exemplary embodiment depicted in FIG. 6A, the reason why the output voltage Vref is a high voltage of 1.2V is now provided.

A current having PTAT characteristics as in FIG. 6A increases based upon absolute temperature. However, the current has characteristics as illustrated in FIG. 6B in a general temperature range of −50-100° C. That is, when temperature-variant current components I(temp_variant) and temperature-invariant current components I(temp_invariant) of the current are separately considered, the temperature-variant current components I(temp_variant) offset the voltage $V_{GS}$ and the temperature-invariant current components I(temp_invariant) are not needed. A high voltage of 1.2 V is generated due to such unnecessary current components and an output voltage of a general bandgap reference voltage generating circuit may be reduced if the unnecessary current components are controlled.

As such, exemplary embodiments of the present invention can provide methods of generating a low reference voltage by removing temperature-invariant current components from current components generated in a constant current source circuit included in a general bandgap reference voltage generating circuit.

Figure 7:
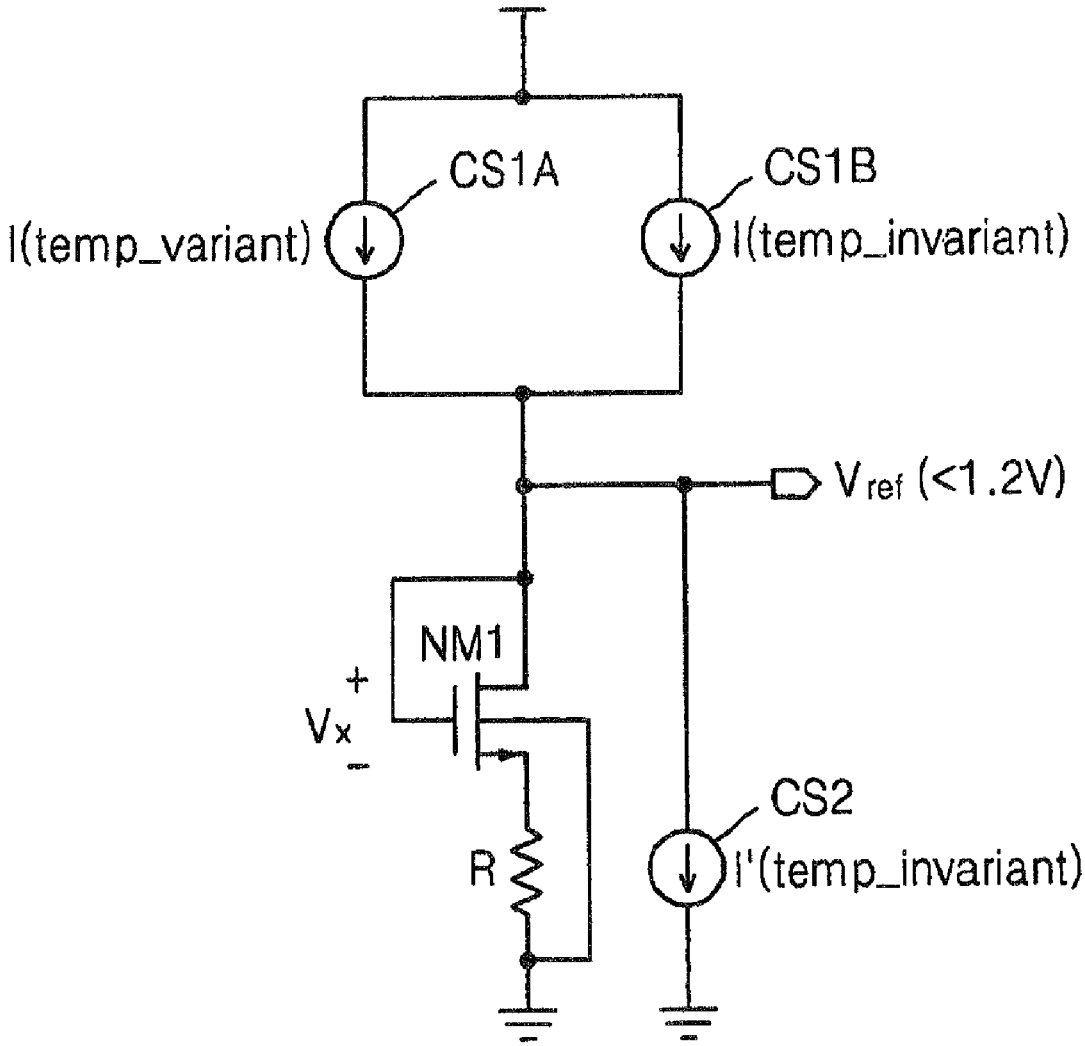
FIG. 7 is a schematic diagram for describing a concept of a circuit for generating a low reference voltage, according to an exemplary embodiment of the present invention.

FIG. 7 is a schematic diagram for describing a circuit for generating a low reference voltage by removing some temperature-invariant current components, according to an exemplary embodiment of the present invention. Constant current sources CS1A, CS1B respectively and equivalently represent temperature-variant current components I(temp_variant) and temperature-invariant current components I(temp_invariant) included in the current I(PTAT) output from the constant current source circuit illustrated in FIG. 11B. A transistor NM1 and a resistor R correspond to a load circuit for converting a current into a voltage. A constant current source CS2 equivalently represents some temperature-invariant current components I'(temp_invariant) corresponding to a portion of the temperature-invariant current components I(temp_invariant).

Figure 12:
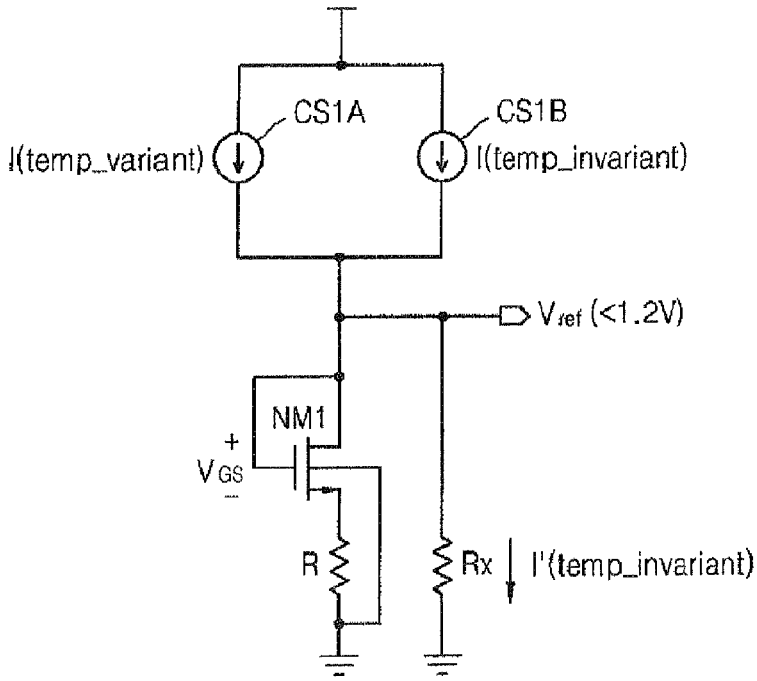
FIG. 12 is a circuit diagram of the circuit illustrated in FIG. 7, according to an exemplary embodiment of the present invention.

In FIG. 7, when an output voltage Vref is a constant voltage, if the temperature-invariant current components I'(temp_invariant) flow through a predetermined current branch, the temperature-invariant current components I'(temp_invariant) may be substituted by a resistor Rx as illustrated in FIG. 12.

Figure 13A:
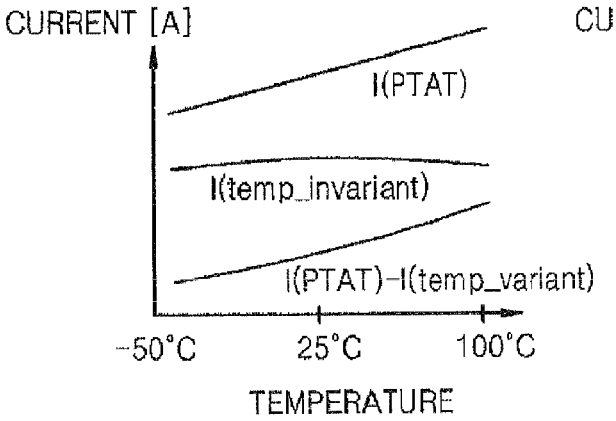
FIG. 13A is a graph showing temperature-current characteristics of the circuit illustrated in FIG. 12, according to an exemplary embodiment of the present invention.
Figure 13B:
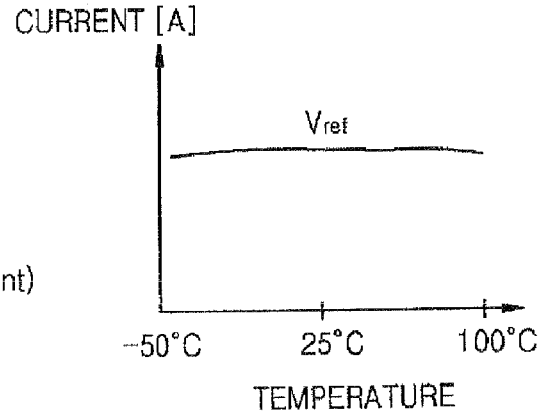
FIG. 13B is a graph showing temperature-voltage characteristics of the circuit illustrated in FIG. 12, according to an exemplary embodiment of the present invention.

FIG. 12 is circuit diagram of an exemplary embodiment of the circuit illustrated in FIG. 7 when a portion of the temperature-invariant current components I'(temp_invariant) are substituted by a resistor Rx. FIG. 13A is a graph showing temperature-current characteristics of the circuit illustrated in FIG. 12. FIG. 13B is a graph showing temperature characteristics of an output voltage Vref when the temperature-invariant current components I'(temp_invariant) flow through a current branch having the resistor Rx so as to be removed from a current I(PTAT).

In FIG. 12, a gate-source terminal voltage $V_{Gs}$ of a transistor NM1 is represented as Equation [2].

$$V_{GS} = nV_T \ln \frac{I_{PTAT} - I'_{temp_invariant}}{I_S} + V_{th} \quad \text{Equation [2]}$$

Since the gate-source terminal voltage $V_{GS}$ has a very small variation with regard to a current $I_{PTAT}-I'_{temp_invariant}$, the gate-source terminal voltage $V_{GS}$ may be assumed to be constant. Then, Vref_prop(<1.2 V) is represented as Equation [3].

$$\text{Vref_prop}(<1.2V) = V_{GS} + (I_{PTAT} - I'_{temp_invariant})R = V_{GS} + \left(I_{PTAT} - \frac{Vref}{Rx}\right)R \quad \text{Equation [3]}$$

Equation [4] is obtained by representing Equation 3 with regard to Vref.

$$\text{Vref_prop} = \frac{R_X}{R_X + R}(V_{GS} + I_{PTAT}R) \quad \text{Equation [4]}$$

Accordingly, as in Equation [4], an output voltage $V_{GS}+I_{PTAT}R$ of a bandgap reference voltage generating circuit may be scaled by Rx and R.

$V_{GS_}$conv of the circuit illustrated in FIG. 6A is as given by Equation [5], and $V_{GS_}$prop of the circuit illustrated in FIG. 12 according to an exemplary embodiment of the present invention, is as given by Equation [6].

$$V_{GS_conv} = nV_T \ln \frac{I_{PTAT}}{I_S} + V_{th} \quad \text{Equation [5]}$$

$$V_{GS_prop} = nV_T \ln \frac{I_{PTAT} - I'_{temp_invariant}}{I_S} + V_{th} \quad \text{Equation [6]}$$

However, with reference to Equations [5] and [6], a current according to a conventional $V_{GS}$ of Equation [4] is reduced by $I_{PTAT}-I'_{temp_invariant}$ in a circuit according to an exemplary embodiment of the present invention.

This means that a temperature gradient varies with regard to $V_{GS}$ of Equation [4] and thus the temperature gradient regarding $V_{GS}$ of a bandgap reference voltage generating circuit is equalized to the temperature gradient regarding $V_{GS}$ of a circuit according to an exemplary embodiment of the present invention, as Equation [7].

$$\frac{\partial V_{GS_conv}}{\partial T} = \frac{\partial V_{GS_prop}}{\partial T} \quad \text{Equation [7]}$$

Equation 8 is obtained when Equation [7] is differentiated by applying a value for each $V_{GS}$ of Equations [5] and [6].

$$n\frac{V_T}{T}\ln\frac{I_{PTAT}}{I_S} + nV_T\frac{\partial \ln\frac{I_{PTAT}}{I_S}}{\partial T} + \frac{\partial V_{th}}{\partial T} = n\frac{V_T}{T}\ln\frac{I_{PTAT} - I'_{temp\ invariant}}{I_S} + nV_T\frac{\partial \ln\frac{I_{PTAT} - I'_{temp_invariant}}{I_S}}{\partial T} + \frac{\partial V_{th}}{\partial T} \quad \text{Equation [8]}$$

Equation [9] is obtained by rearranging Equation [8].

$$\ln\frac{I_{PTAT}}{I_S} + \frac{T}{I_{PTAT}}\frac{\partial I_{PTAT}}{\partial T} = \ln\frac{I_{PTAT} - I'_{temp_invariant}}{I_S} + \frac{T}{I_{PTAT} - I'_{temp_invariant}}\frac{\partial I_{PTAT}}{\partial T} \quad \text{Equation [9]}$$

In Equation [9], a first term of the temperature gradient regarding $V_{GS}$ of the present invention has $I_{PTAT}-I'_{temp_invariant}$ as a numerator so as to be a decreasing term, and a second term has $I_{PTAT}-I'_{temp_invariant}$ as a denominator so as to be an increasing term. As such, the temperature gradient regarding $V_{GS}$ of the bandgap reference voltage generating circuit may be equalized to the temperature gradient regarding $V_{GS}$ of the present invention.

In Equation [9], factors other than $I'_{temp_invariant}$ are already-known constants and thus $I'_{temp_invariant}$ satisfying $$\frac{\partial V_{GS_CONV}}{\partial T} = \frac{\partial V_{GS_PROP}}{\partial T}$$

may be obtained. Also, the resistor Rx according to a desired output voltage Vref(<1.2 V) may be obtained by using Equation [10].

$$R_X = \frac{Vref}{I'_{temp_invariant}} \quad \text{Equation [10]}$$

A minimum value of Vref, which is obtained from Equation [10], is greater than or equal to $V_{GS}$ that turns on a metal-oxide semiconductor (MOS) transistor. Thus, a minimum value of Rx is $$R_x \geq \frac{V_{GS}}{I}.$$

Now, values of Vref, $V_{GS}$, and $I_{PTAT}-I'_{temp_invariant}$ in Equation [3] are already obtained and thus a value of the resistor R may be lastly obtained.

Figure 14:
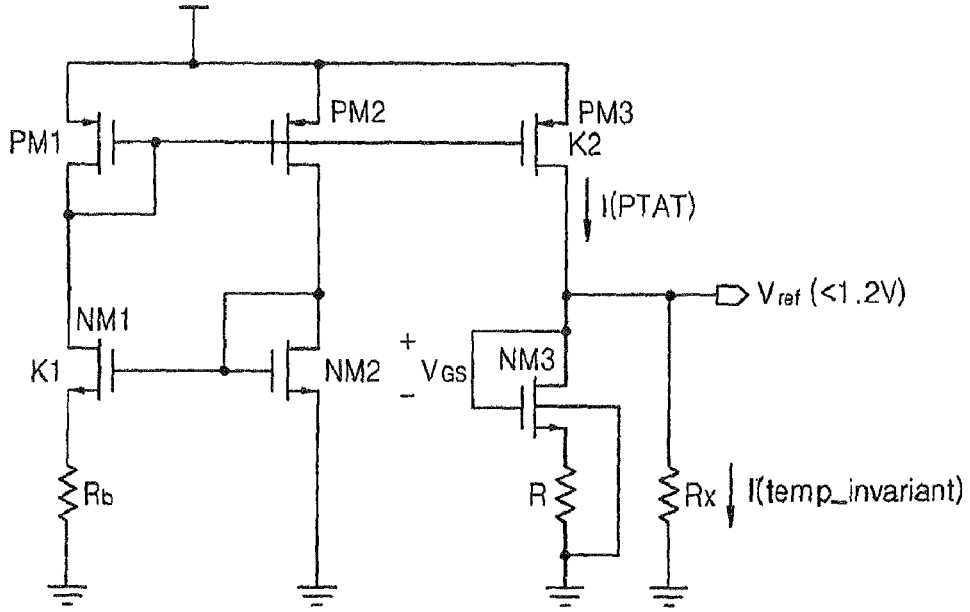
FIG. 14 is a circuit diagram of a zero-thermal coefficient (TC) bandgap reference voltage generating circuit according to an exemplary embodiment of the present invention.

FIG. 14 is a circuit diagram of a zero-TC bandgap reference voltage generating circuit operating in a weak inversion bias state, according to an exemplary embodiment of the present invention.

In FIG. 14, an output voltage Vref is represented as Equation [11].

$$Vref = \frac{R_x}{R_X + R}(V_{GS} + I_{PTAT}R) = \frac{R_x}{R_x + R}\left(nV_T 1n\frac{I_{PTAT} - I_{temp_invariant}}{I_s} + Vth + nV_T\frac{R}{R_b}K_2 1nK_1\right) \quad \text{Equation [11]}$$

Equation [12] is obtained by differentiating Equation [11] with regard to temperature.

$$\frac{\partial V_{ref}}{\partial T} = \frac{R_x}{R_x + R}\left(n\frac{V_T}{T}1n\frac{I_{PTAT} - I_{temp_invariant}}{I_s} + \frac{\partial Vth}{\partial T} + nV_T\left(\frac{1}{T_D}\frac{\partial I_{PTAT} - I_{temp_invariant}}{\partial T} - \frac{1}{I_s}\frac{\partial I_s}{\partial T}\right) + n\frac{V_T}{T}\frac{R}{R_b}K_2 1nK_1\right) = \frac{R_x}{R_x + R}\left(\frac{V_{GS} - Vth}{T} + \frac{\partial Vth}{\partial T} + \frac{nV_T}{T} - \frac{2nV_T}{T} + n\frac{v_T}{T}\frac{R}{R_b}K_2 1nK_1\right) = \frac{R_x}{R_x + R}\left(\frac{V_{GS} - Vth - nV_T}{T} + n\frac{V_T}{T}\frac{Rb}{R}K_2 1nK_1\frac{\partial Vth}{\partial T}\right) \quad \text{Equation [12]}$$

In Equation [12], the output voltage Vref is independent of temperature and thus Equation [13] is satisfied.

$$\frac{\partial Vref}{\partial T} = 0 \quad \text{Equation [13]}$$

Equation 14 is obtained by substituting Equation [13] into Equation [12].

$$V_{GS} = Vth + nV_T - nV_T\frac{R}{R_b}K_2 1nK_1 + C1T \quad \text{Equation [14]}$$

Equation [15] is obtained by substituting Equation [14] into Equation [11] and rearranging Equation [11].

$$Vref = \frac{R_x}{R_x + R}(nV_T + Vth + C1 \cdot T)\left(C1 = \frac{\partial Vth}{\partial T} < 0\right) \quad \text{Equation [15]}$$

Accordingly, as in Equation [15], $V_T$ is directly proportional to temperature and C1 is inversely proportional to temperature and thus a zero-TC bandgap reference voltage generating circuit may be implemented by appropriately controlling a value of a resistor.

As a result, in a circuit according to an exemplary embodiment of the present invention, a resistor R and a resistor Rx are proportionally used and thus may mutually offset variations in process or temperatures. Also, a desired output voltage may be obtained by using $I'_{temp_invariant}$ and thus a low reference voltage may be generated.

Figure 15:
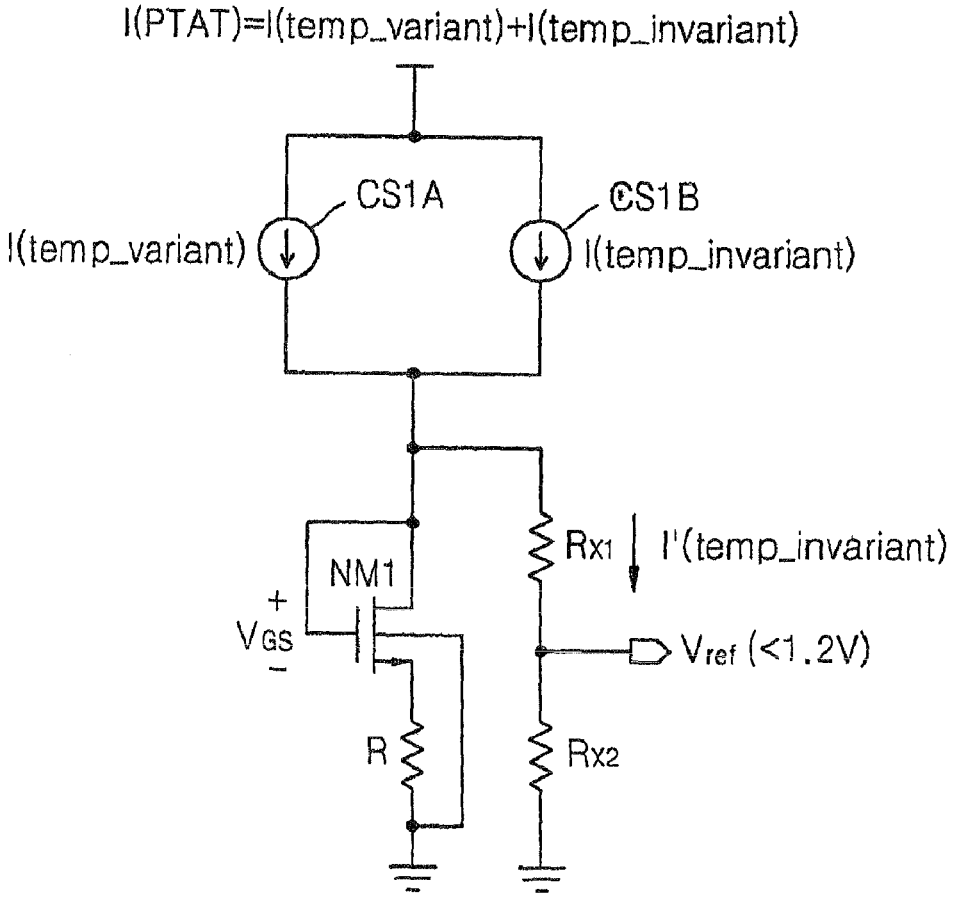
FIG. 15 is a circuit diagram showing a different example of a resistor tap in a zero-TC bandgap reference voltage generating circuit according to an exemplary embodiment of the present invention.

FIG. 15 is a circuit diagram showing a resistor tap in a zero-TC bandgap reference voltage generating circuit according to an exemplary embodiment of the present invention and shows that various voltages may be generated by using the resistor tap of the zero-TC bandgap reference voltage generating circuit.

If a circuit for generating a driving voltage of a logic part of a display driver IC adopts the resistor tap illustrated in FIG. 15, although a reference voltage generating circuit may generate an output voltage Vref of 1.2 V, the zero-TC bandgap reference voltage generating circuit according to an exemplary embodiment of the present invention may generate the output voltage Vref to have various values.

Turning now to the matter of process variations, the operation of the reference voltage generating circuit now takes into consideration semiconductor process variations.

Figure 8:
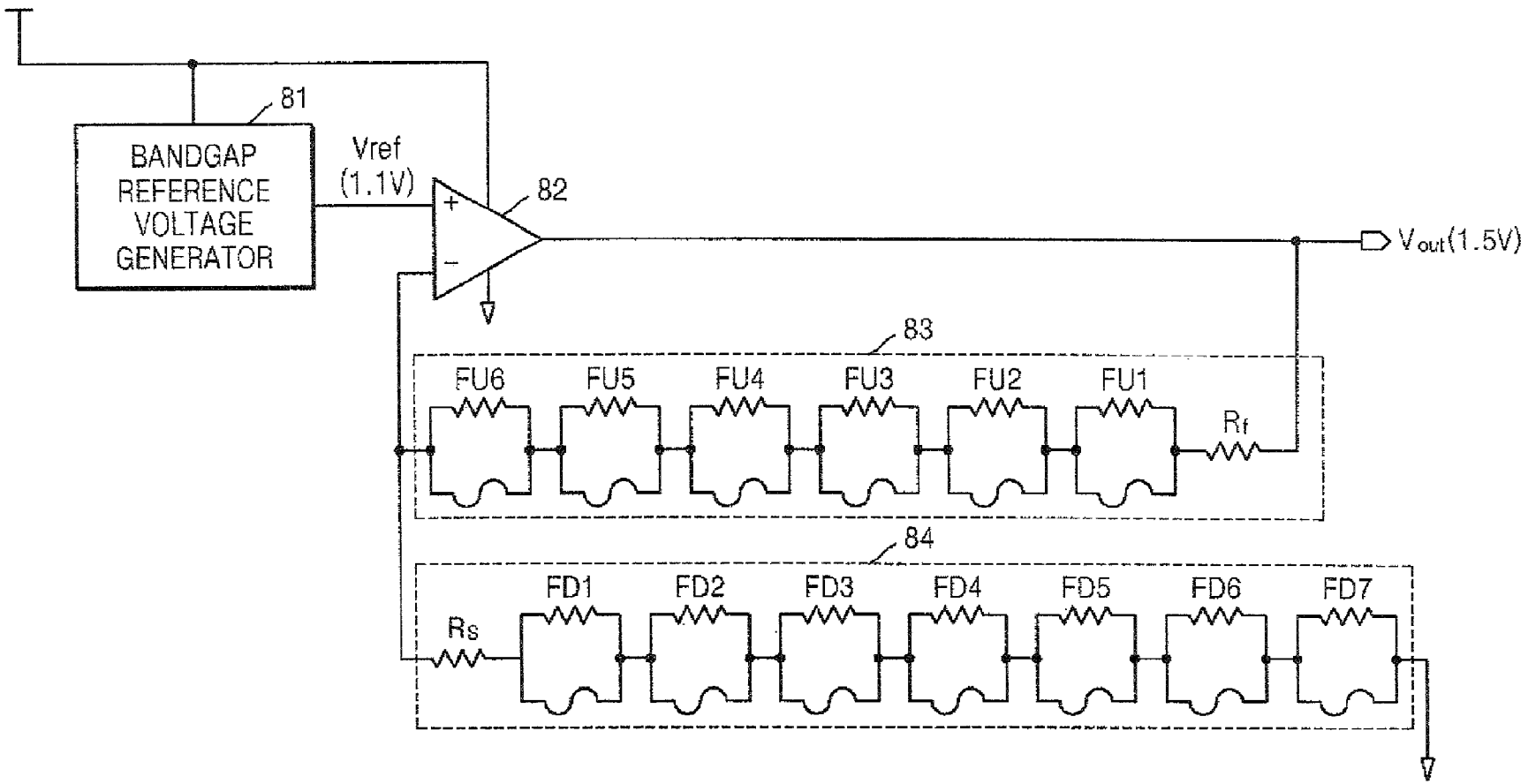
FIG. 8 is a circuit diagram of a reference voltage regulator in accordance with an exemplary embodiment of the present invention.

FIG. 8 is a circuit diagram of a circuit in accordance with an exemplary embodiment of the present invention, in which a reference voltage generated by a reference voltage generating circuit is regulated by using a fusing device so as to accurately generate a target voltage. The circuit illustrated in FIG. 8 is generally referred to as a reference voltage regulator. The reference voltage regulator includes a bandgap reference voltage generator 81, an operational amplifier 82, and first and second resistor sets 83, 84.

In the first resistor set 83, a resistor Rf and a plurality of adjusting resistance devices are connected in series, and a fuse is connected between both terminals of each adjusting resistance device. In the second resistor set 84, a resistor Rs and a plurality of adjusting resistance devices are connected in series, and a fuse is connected between both terminals of each adjusting resistance device.

However, although the reference voltage generating circuit has an output voltage of 1.5 V, the output voltage may vary as a result of processes variations. To address this, resistors of a fusing circuit including first and second resistor sets 83, 84 take into consideration a ±30% margin from the output voltage. In an exemplary embodiment of an IC using a driving voltage of 1.5 V, a fusing range is 1.1 V-1.9 V.

The bandgap reference voltage generator 81 generates the output voltage Vref of 1.1 V-1.2 V which is input to the operational amplifier 82. Various combinations of the resistors Rf, Rs may be used to regulate 1.1 V at 1.5 V. An exemplary circuit uses the resistors Rf, Rs as Rf=320 KΩ, Rs=880 KΩ.

Although the reference voltage may be 1.1 V, the reference voltage may vary by ±30% so as to be 0.8 V-1.4 V. In this case, an ultimate output voltage Vout of the reference voltage regulator is 1.1 V-1.9 V and the ultimate output voltage Vout is regulated at 1.5 V by using the fusing device.

In the exemplary embodiment shown in FIG. 8, when the output voltage Vref is 0.8 V, the ultimate output voltage Vout is 1.1 V and thus the resistor Rf is increased from 320 KΩ to 770 KΩ to increase the ultimate output voltage Vout to the target voltage of 1.5 V. That is, a resistor of 450 KΩ (770 KΩ-320 KΩ) is additionally used for fusing. On the other hand, when the output voltage Vref is 1.4 V, the ultimate output voltage Vout is 1.9 V and thus the resistor Rs is increased from 880 KΩ to 4480 KΩ to decrease the ultimate output voltage Vout to the target voltage of 1.5 V. In this case, a resistor of 3600 KΩ (4480 KΩ-880 KΩ) is additionally used for fusing. That is, in the above two cases, a quite large total resistance of 4050 KΩ is additionally used for fusing.

In other words, since the output voltage Vref is fixed to be 1.1 V-1.2 V, a large resistance is used for fusing to generate a desired output voltage and thus a circuit area increases. Accordingly, by symmetrically using the resistors Rf, Rs such that a small fusing resistance is used, a condition of Vref=2/Vout is met and satisfies small area characteristics of mobile devices.

Figure 9:
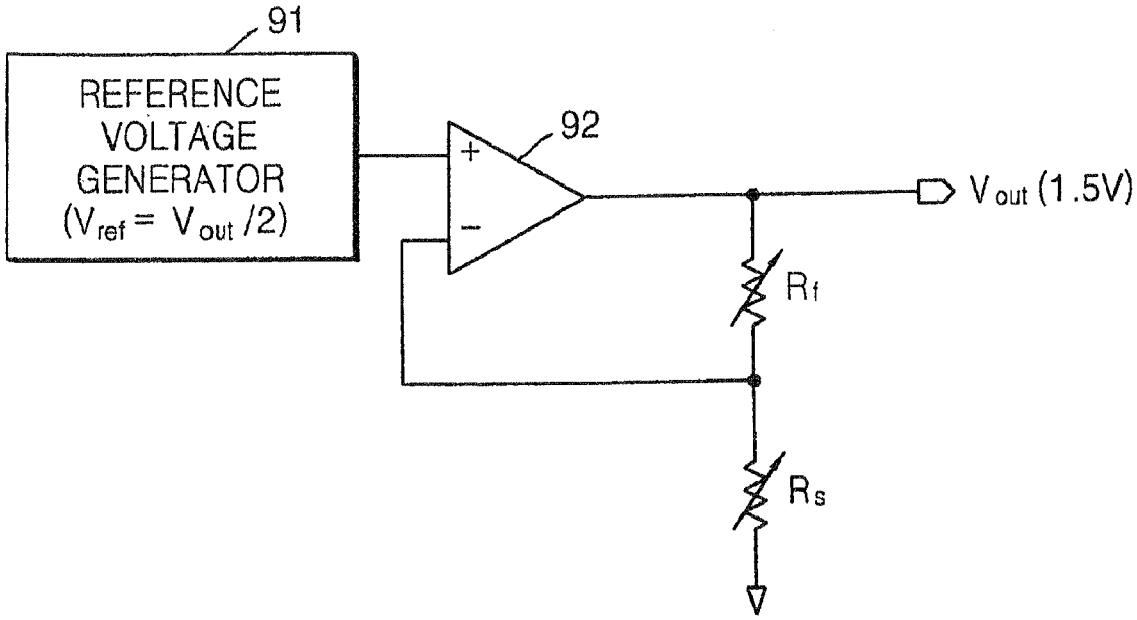
FIG. 9 is a circuit diagram of a reference voltage regulator according to an exemplary embodiment of the present invention.

FIG. 9 is a circuit diagram of a reference voltage regulator for regulating an output voltage according to process variations by using a zero-TC reference voltage generating circuit, according to an exemplary embodiment of the present invention. The reference voltage regulator includes a reference voltage generator 91, an operational amplifier 92, and variable resistors Rf, Rs. The reference voltage regulator may be implemented by using the variable resistors Rf, Rs and fuses as illustrated in FIG. 16.

Figure 16:
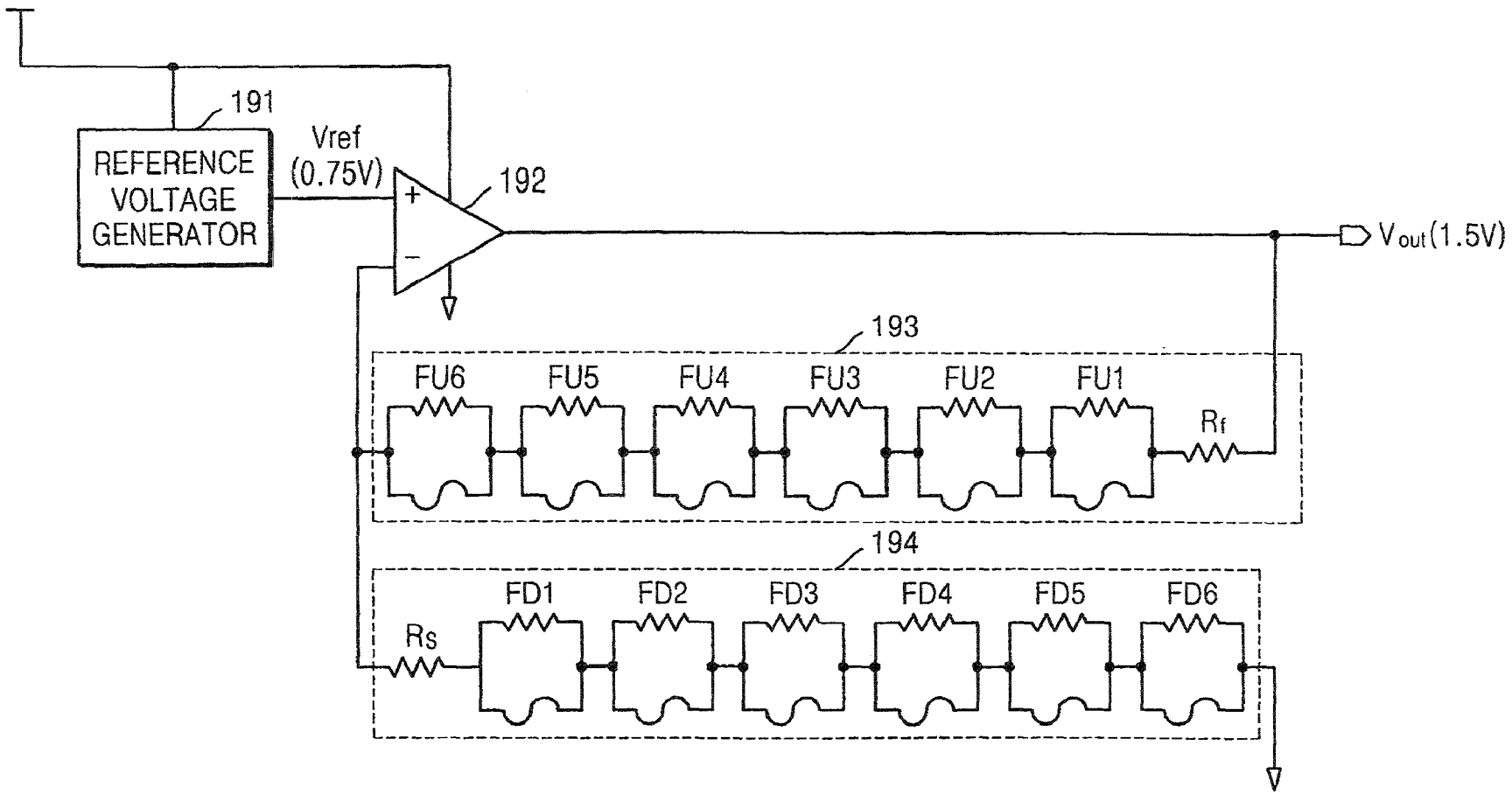
FIG. 16 is a circuit diagram of a reference voltage regulator in which variable resistors illustrated in FIG. 9 are implemented by using fuses, according to an exemplary embodiment of the present invention.

FIG. 16 is a circuit diagram of a reference voltage regulator in which the variable resistors Rf, Rs illustrated in FIG. 9 are implemented by using fuses, according to an exemplary embodiment of the present invention. The reference voltage regulator includes a reference voltage generator 191, an operational amplifier 192, and first and second resistor sets 193, 194.

In the first resistor set 193, the resistor Rf and a plurality of adjusting resistance devices are connected in series, and a fuse is connected between both terminals of each adjusting resistance device. In the second resistor set 194, the resistor Rs and a plurality of adjusting resistance devices are connected in series, and a fuse is connected between both terminals of each adjusting resistance device.

According to an exemplary embodiment, the resistors Rf, Rs may have the same value of, for example, 700 KΩ. In this case, an output voltage Vout is as given by Equation 16.

$$0.75\left(1+\frac{700\text{ K}}{700\text{ K}}\right)=1.5\text{ V} \qquad \text{Equation [16]}$$

Although a reference voltage Vref is designed to be 0.75 V, in an exemplary embodiment, the reference voltage Vref may vary by ±30% so as to be 0.55 V-0.95 V. In this case, the output voltage Vout ultimately output from the reference voltage regulator is 1.1V-1.9 V and the output voltage Vout is regulated at 1.5 V by using a fusing device.

In FIG. 16, if the resistors Rf, Rs have the same value, when the reference voltage Vref is 0.55 V, the output voltage Vout is 1.1 V and thus the resistor Rf is increased from 700 KΩ to 1209 KΩ to increase the output voltage Vout to a target voltage of 1.5 V. That is, a resistor of 509 KΩ (1209 KΩ-700 KΩ) is additionally used for fusing. On the other hand, when the reference voltage Vref is 0.95 V, the output voltage Vout is 1.9 V and thus the resistor Rs is increased from 700 KΩ to 1209 KΩ to decrease the output voltage Vout to the target voltage of 1.5 V. In this case, a resistor of 509 KΩ (1209 KΩ-700 KΩ) is also additionally used for fusing. That is, in the above two cases, a total resistance of 1018 KΩ is additionally required for fusing.

In this manner, when the reference voltage Vref is generated to have various values, the resistors Rf, Rs are symmetrically used and thus a total resistance for fusing is reduced by 3032 KΩ. Namely, in the conventional case the additional resistance is 4050 KΩ, while in accordance with an exemplary embodiment of the present invention the additional resistance is 1018 KΩ. Accordingly, an area used for the fusing resistance is reduced by approximately three quarters.

Figure 17:
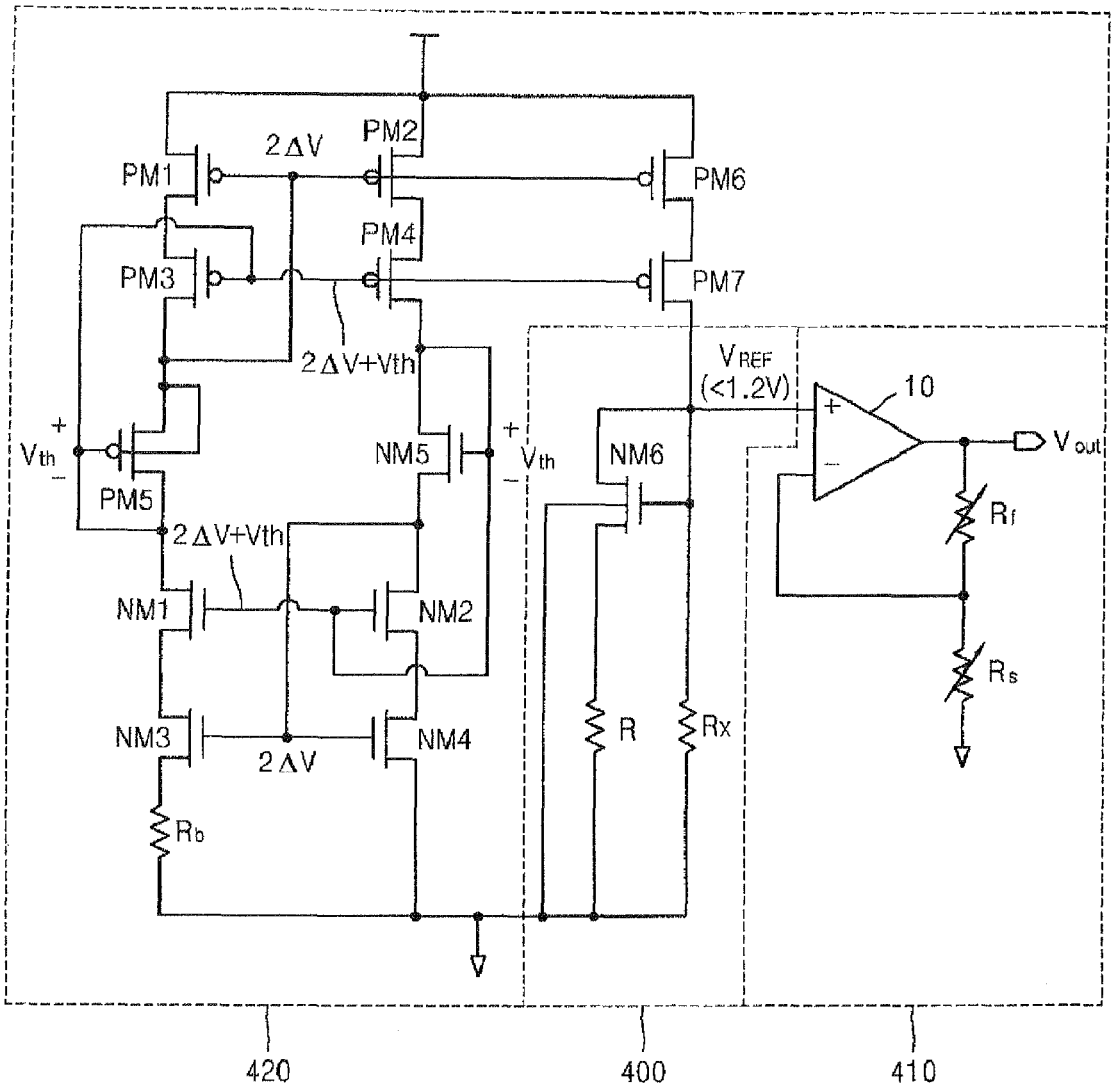
FIG. 17 is a circuit diagram of a combination of a zero-TC bandgap reference voltage generating circuit, a low reference voltage generating apparatus, and a self bias cascode current source generating circuit according to an exemplary embodiment of the present invention.

FIG. 17 is a circuit diagram of a reference voltage generating apparatus that is a combination of a zero-TC bandgap reference voltage generating circuit portion 400, a low reference voltage generating apparatus portion 410, and a self bias cascode current source generating circuit portion 420, according to an exemplary embodiment of the present invention. Each circuit portion illustrated in FIG. 17 has described above in detail and thus detailed descriptions thereof will be omitted here.

Figure 18:
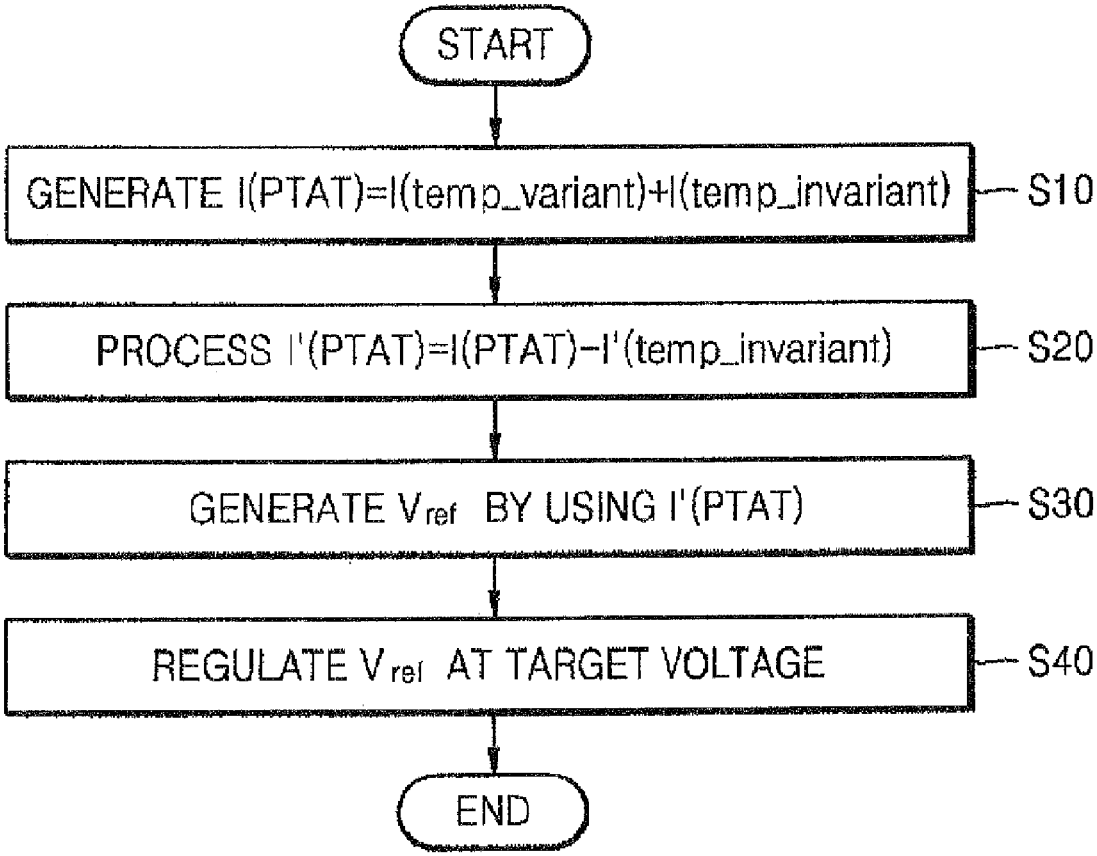
FIG. 18 is a flowchart of a reference voltage generating method according to an exemplary embodiment of the present invention.

FIG. 18 is a flowchart of a reference voltage generating method according to an exemplary embodiment of the present invention. Initially, a reference current I(PATA) is generated (S10) by operating a constant current source circuit. For example, the reference current I(PATA) which contains temperature-variant current components I(temp_variant) and temperature-invariant current components I(temp_invariant) is generated by using self bias without an additional current branch from the constant current source circuit formed of a cascode current mirror circuit.

A portion of the temperature-invariant current components I'(temp_invariant) corresponding to a portion of the temperature-invariant current components I(temp_invariant) are removed from the reference current I(PATA) generated (S10) to ground through a current branch that is different from a current branch of a load circuit. Here, the load circuit functions convert a current into a voltage. That is, the temperature-invariant current components I'(temp_invariant) are processes/removed (S20) from the reference current I(PATA) by using the circuit illustrated in FIG. 7 so as to generate a current I' (PATA).

The current I'(PATA) generated (S20) is converted into a voltage so as to generate (S30) an operating reference voltage Vref. According to an exemplary embodiment of the present invention, a resistance of the load circuit and a resistance of the current branch for removing the temperature-invariant current components I'(temp_invariant) are determined so as to satisfy a condition for equalizing electrical characteristics of the constant current source circuit for generating the reference current I(PATA) and electrical characteristics of the load circuit.

Lastly, the reference voltage Vref generated (S30) is regulated (S40) at a target voltage through an amplifier circuit for regulating a gain by using fuses. The regulating is performed to accurately generate the target voltage regardless of semiconductor process variations.

While the present invention has been particularly shown and described with reference to exemplary embodiments thereof, it will be understood that various changes in form and details may be made therein without departing from the spirit and scope of the following claims.

What is claimed is:

1. A reference voltage generating method comprising:

generating a reference current from a current source circuit;

removing a portion or a total of temperature-invariant current components included in the reference current to a ground terminal through a current branch different from a branch that includes a load circuit; and converting remaining current components obtained by removing the portion of the temperature-invariant current components from the reference current, into a reference voltage.

2. The reference voltage generating method of claim 1, wherein the load circuit is configured such that the reference voltage is constant regardless of temperature variations.

3. The reference voltage generating apparatus of claim 1, wherein a resistance device included in the load circuit is determined such that the reference voltage is constant regardless of time variations.

4. A reference voltage generating apparatus comprising:

a current source circuit which outputs a reference current to a target node, the reference current including temperature-variant current components and temperature-invariant current components;

a first current branch circuit connected between the target node and a ground terminal, that forms a current path through which a portion or a total of the temperature-invariant current components flows; and a second current branch circuit connected between the target node and the ground terminal and having a load circuit, that forms a current path through which a current obtained by removing a current that flows through the first current branch circuit from the reference current flows.

5. The reference voltage generating apparatus of claim 4, wherein the load circuit comprises a transistor and a resistance device connected in series between the target node and the ground node.

6. The reference voltage generating apparatus of claim 5, wherein the transistor comprises an NMOS (N-channel Metal Oxide Semiconductor) transistor.

7. The reference voltage generating apparatus of claim 5, wherein the load circuit is configured such that a drain terminal of the transistor is connected to the target node, a source terminal of the transistor is connected to a first terminal of the resistance device, a gate terminal of the transistor is connected to the drain terminal, and a second terminal of the resistance device is connected to the ground terminal.

8. The reference voltage generating apparatus of claim 4, wherein the first current branch circuit is configured to have a resistance device connected between the target node and the ground terminal.

9. The reference voltage generating apparatus of claim 4, wherein the first current branch circuit is configured to have a plurality of resistance devices connected in series between the target node and the ground terminal, and selects one of nodes to which the plurality of the resistance devices are connected, as an output terminal.

10. The reference voltage generating apparatus of claim 4, wherein the load circuit is configured such that a voltage output from the target node is constant regardless of temperature variations.

11. The reference voltage generating apparatus of claim 4, wherein resistances of the first current branch circuit and the second current branch circuit are determined such that a voltage output from the target node is constant regardless of temperature variations.

12. The reference voltage generating apparatus of claim 2, wherein the current source circuit comprises a plurality of cascode current mirror circuits, and wherein a gate terminal voltage of each transistor in the cascode current mirror circuits is applied using self bias.

13. The reference voltage generating apparatus of claim 4, wherein the current source circuit comprises:

a cascode current minor circuit in which first and second current paths are between a source voltage terminal and the ground terminal and a plurality of current mirror circuits, which cause the same current to flow through the first and second current paths, are cascode-connected;

a resistance device, connected to one of the first and second current paths, that controls a current flowing through a connected current path; and a buffer circuit, connected to one of the first and second current paths, that causes a current to flow to the target node, the current being the same current as a current flowing through a connected current path.

14. The reference voltage generating apparatus of claim 13, wherein a bias voltage that operates the cascode current mirror circuit is generated using self bias without an additional current branch.

15. The reference voltage generating apparatus of claim 13, wherein the cascode current mirror circuit comprises a self bias transistor in each of the first and second current paths and that generates a bias voltage used for the current mirror circuits forming the first and second current paths, by using a voltage applied to the self bias transistor.

16. The reference voltage generating apparatus of claim 4, further comprising an operational amplifying circuit which amplifies voltages output through the target node, wherein a target voltage is generated by controlling a gain of the operational amplifying circuit.

17. The reference voltage generating apparatus of claim 16, wherein the operational amplifying circuit comprises an operational amplifier and a resistance circuit coupled between an output terminal of the operational amplifier and a second input terminal of the operational amplifier, wherein the resistance circuit comprises a first resistor set and a second resistor set whose resistances are controlled according to whether fuses coupled in parallel to respective resistances are cut, wherein a first input terminal of the operational amplifier is connected to the target node, wherein the first resistor set is connected between the second input terminal and an output terminal of the operational amplifier, and wherein the second resistor set is connected between the second input terminal of the operational amplifier and the ground terminal.

18. The reference voltage generating apparatus of claim 17, wherein each of the first resistor set and the second resistor set comprises an initial setting resistance device and a plurality of controlling resistance devices connected in series, and wherein a fuse is connected to both terminals of each of the controlling resistance devices.

19. The reference voltage generating apparatus of claim 4, wherein the target node is selected as an output terminal.

20. The reference voltage generating apparatus of claim 4, wherein the temperature-variant current components comprise current components which vary in proportion to absolute temperature.

* * * * *